8-108.1 $$$ SR
X696A OR 4,600,406

United States Patent [19]
Corte

[11] Patent Number: 4,600,406
[45] Date of Patent: Jul. 15, 1986

[54] METHOD OF LOW TEMPERATURE BLEACHING WITH REDUCED AMOUNTS OF CHLORINE REQUIRING REDUCED BLEACHING INTERVALS

[75] Inventor: George E. Corte, Wyandotte, Mich.

[73] Assignee: Diversey Wyandotte Corporation, Wyandotte, Mich.

[21] Appl. No.: 715,183

[22] Filed: Mar. 22, 1985

[51] Int. Cl.[4] ..... D06L 3/06
[52] U.S. Cl. ..... 8/108 R; 8/107
[58] Field of Search ..... 252/99, 109, 121, 174.12, 252/187.25, 187.29, 187.33, 187.34, 554, DIG. 12; 8/111, 108 R

[56] References Cited

U.S. PATENT DOCUMENTS

| | | | |
|---|---|---|---|
| 2,461,105 | 2/1949 | Bloch et al. | 8/105 |
| 3,519,569 | 7/1970 | Diaz | 8/108 |
| 3,583,922 | 6/1971 | McClain et al. | 252/99 |
| 3,700,401 | 10/1972 | Spangier et al. | 8/108 |
| 3,850,833 | 11/1974 | Koceich et al. | 252/99 |
| 4,096,029 | 6/1978 | Mills | 162/89 |
| 4,235,599 | 11/1980 | Davis et al. | 8/108 |
| 4,382,799 | 5/1983 | Davis et al. | 8/107 |

*Primary Examiner*—Paul Lieberman
*Assistant Examiner*—John F. McNally
*Attorney, Agent, or Firm*—Basile, Weintraub & Hanlon

[57] ABSTRACT

A method of bleaching textile materials in water at lower temperatures and reduced time intervals wherein:
a source of bromide ions is added to the water to impart an initial concentration between 1 and 25 ppm;
a chlorine ion source is added to the water to yield an initial concentration between 25 and 90 ppm;
the wash water and textile materials are agitated for an interval between 30 seconds and 5 minutes; and
the bleached textiles are recovered.

The process may be carried at temperatures between 80° and 120° F. Preferred ion donating sources are sodium bromide and sodium hypochlorite. If desired, the sodium bromide may be compounded with conventional detergent formulations.

24 Claims, No Drawings

T 8/108.1

METHOD OF LOW TEMPERATURE BLEACHING WITH REDUCED AMOUNTS OF CHLORINE REQUIRING REDUCED BLEACHING INTERVALS

BACKGROUND OF THE INVENTION

1. Field of the Invention:

This invention relates to an improved method of bleaching in aqueous systems such as laundry operations, processing of textile materials, or fabric goods using a mixture of chlorine- and bromine-containing compounds at lower temperatures and shortened time intervals.

2. Prior Art:

The use of halogen-releasing agents for bleaching in aqueous solution, as part of the processing or laundering of textile materials, is well known. Traditionally, chlorine-containing bleaching agents have been preferred because of their bleaching ability, relative low cost and acceptable odors. Examples of such chlorine-containing bleaching agents include chlorine gas, alkali metal hypochorites and organo-chlorine complexes.

Most chlorine bleaching agents employed in laundering or processing textile materials require temperatures of approximately 160° F. to effect adequate bleaching. Reduction in process temperature is desirable for the associated energy savings. To this end, it has been found that supplementing chlorine bleaching agents with bromine-containing compounds in a highly alkaline solution provides effective bleaching at lower temperatures. To accomplish effective bleaching, low temperature bleaching methods require large concentrations of bromine-chlorine bleaching compounds. The textile material or fabric to be bleached is exposed to high concentrations of halogen ions.

Extended periods of contact between aqueous bleaching agents in high concentrations and the textiles to be treated destroys fabric integrity, reduces the useful life of the fabric, and causes discoloration. To date, no bleaching method has been developed which produces effective whitening in shortened bleaching intervals.

Bleaching which occurs in highly alkaline aqueous media can have similar detrimental effects on fabric durability and appearance. Thus, a bleaching process in which equivalent cleaning and whitening could be accomplished in shortened time periods requiring less halogenated bleaching agent, is highly desirable. Thus, it would be desirable to provide a method of bleaching fabrics and other materials at or near a solution pH of 7.

It is also desirable to provide a bleaching method which can occur at lower process temperatures.

SUMMARY OF THE INVENTION

The present invention is predicated on the discovery that effective bleaching of textile materials and fabric goods can be accomplished at low temperatures and/or at reduced time intervals when the goods are exposed to an aqueous solution which contains a conventional bleaching agent augmented by a bromide ion donor.

The present invention, thus, generally, provides a method of bleaching textile goods in which a source of bromide ion is added to the wash solution prior to the addition of a source of chlorine-containing ions. By practicing the present invention, bleaching in significantly shortened process times and smaller initial chlorine ion concentrations approximately one-half those employed in present technology is achieved.

For a more complete understanding of the present invention reference is made to the following detailed description and accompanying examples.

DESCRIPTION OF THE PREFERRED EMBODIMENT

The present invention is predicated on the discovery that the use of bromide ion in solution can accomplish effective bleaching at significantly lower pH levels than previously possible with conventional chlorine bleaches alone. Lower pH levels during bleaching provide better fabric color retention and reduce fabric damage. It has also been found that the lower pH levels required with bromide-enhanced bleaching lessen the amount of fabric yellowing caused by chlorine retention in the conventionally bleached fabric.

The present invention provides a process in which a source of bromide ions is added to a thoroughly mixed wash solution, already containing the textile goods to be bleached. For optimum results, the pH of the wash solution is maintained between about 6.5 and about 10.5 at a maximum 1 percent solution. Reduced pH in the bleach solution permits the use of lower chlorine levels without sacrificing bleaching efficiency.

In practicing the present invention, the amount of bromide ion material added is such that the initial bromide ion concentration imparted to the solution is between about one and twenty-five ppm.

A material which provides a source of chlorine ions or hypochlorous ions is added to the wash solution containing bromide ions to yield an initial total chlorine ion concentration between about twenty-five and about ninety ppm. The resulting wash solution is maintained at a temperature between about 80° F. and about 120° F. and is agitated for an interval between about thirty seconds and ten mintutes after which the textile goods are recovered and rinsed and the spent wash solution discarded.

If shortened bleaching intervals are desired, larger amounts of chlorine are added to yield an initial chlorine ion concentration of about ninety ppm. The addition of bromide ions enhances the bleaching capability of the solution so that equivalent bleaching is achieved in half the conventional time. By practicing the present invention, optical whitening equivalent to a bleaching time of ten minutes or greater is achieved in one half the time.

Alternately, if reduction of chlorine concentration is desired the addition of a source of bromide ions will permit effective bleaching in wash solutions in which the chlorine ion concentrations have been reduced by as much as 50 percent. In a solution having an initial bromide ion concentration between about one and about twenty-five ppm maintained at a temperature between about 80° F. and about 120° F., effective bleaching can be achieved in conventional time intervals.

The source of bromide ion used herein may be derived from any compound which disassociates to form bromide ions and other radicals and which will not interfere in the bleaching process and any subsequent laundering processes. Inorganic bromide salts such as the alkali or alkaline earth metal bromide salts, e.g., sodium bromide, potassium bromide, magnesium bromide, calcium bromide, and the like, as well as mixtures thereof, can be used. Examples of organic compounds which provide a source of bromide ions suitable for use in this application are organo-N-brominated materials such as N-brominated alkylhydantoins, iscyanurates, melamines, or glycourils, and mixtures thereof.

The bromide ion donor may be compounded with any conventionally known organic surfactant. Anionic, nonionic or amphoteric surfactants or mixtures can be employed. The surfactants can be present alone or can be compounded with builders in detergent compositions.

Examples of suitable anionic surfactants are water-soluble salts of higher molecular weight sulfoxy-containing detergents, such as higher alkylbenzene sulfonates, paraffin sulfonates, olefin sulfonates or fatty alcohol sulfates having long hydrophobic chains having 10 to 20 carbon atoms. Among the sulfated and sulfonated aliphatic compounds anticipated are the sulfuric acid esters of polyhydric alcohols which are partially esterified with higher fatty acids, e.g., coconut oil monoglyceride monosulfate, tallow diglyceride monosulfate; long chain pure or mixed alkyl sulfates, e.g., lauryl sulfate, cetyl sulfate; hydroxy sulfonated higher fatty acid esters, e.g. higher fatty acid esters of low molecular weight alkylol sulfonic acids, e.g. fatty acid esters of isothionic acid; the fatty acid ethanol-amide sulfates; the fatty acid amides of amino alkyl sulfonic acids, e.g., lauric amide of taurine, and the like. Other suitable synthetic anionic detergents include water-soluble soaps of higher fatty acids such as the sodium soap of a 75:25 mixture of tallow and coconut oil fatty acids.

Examples of suitable cationic surfactants which may be used include long chain alkyl quarternary ammonium compounds such as cetyl quarternary ammonium salts. Within this group are included cetyl trimethyl ammonium chloride and cetyl pyridinium chloride.

Nonionic surfactants which can be used in the present invention include the polyoxyethylene ethers of alkyl aromatic hydroxy bodies (e.g., the alkylated polyoxyethylene phenols), the polyoxyethylene ethers of long chain aliphatic alcohols and the polyoxyethylene ethers of hydrophobic propylene oxide polymers, e.g., the condensate of ethylene oxide with polypropylene glycol which condensate contains 80 percent ethylene oxide and has a molecular weight of about 1700, and iso-octyl phenoxy polyoxyethylene ethanol having about 8.5 ethanoxy groups per molecule, and the like. Alkyl amine oxide detergents such as lauryl or myristal dimethyl amine oxides may be present.

The anionic and cationic surface active agents are commonly used in the form of their water-soluble salts. For the synthetic anionic compounds, the alkali metal (e.g. sodium, potassium) salts are preferred, though other salts such as ammonium, amine, alkylolamine, and alkaline earth metals (e.g. calcium, magnesium) salts may be used if desired. For the cationic agents chloride, sulfate, acetate, or like salts may be employed satisfactorily.

Amphoteric surfactants also are contemplated for use in the present invention. Examples of these include the salts of higher alkyl beta amino propionic acids, e.g., sodium N-lauryl beta alanine, the higher alkyl substituted betaines such as lauryldimethylammonium acetic acid; and the imidazoline type exemplified by the disodium salt of 1-(2-hydroxyethyl)-1-(carboxy-methyl)-2-(hexadecyl)-4,5-dihydroimidazolinium hydroxide.

Likewise, the present invention is extremely efficacious in augmenting the liquid detergent disclosed and claimed in copending U.S. patent application Ser. No. 582,267, filed Feb. 22, 1984, the disclosure of which is hereby incorporated by reference.

In practicing the present invention, after the bromide ion source has been added to the wash solution and thoroughly mixed, a source of chlorine, which is present as the hypochlorous ion, is added and thoroughly mixed with the wash solution to yield an initial concentration of hypochlorous ions of between about twenty-five and ninety ppm.

In practicing the present invention, it should be noted that where a powdered bleach composition is employed the bromide and chlorine are added simultaneously. Where a liquid bleach is employed, either a sequential or simultaneous addition can be employed.

Any organic or inorganic salt, which disassociates freely to form the hypochlorous ion may be employed in the process of the present invention. Suitable compounds are the alkali and alkaline earth metal hypochlorites such as sodium hypochlorite, lithium hypochlorite or calcium hypochlorite. Other useful hypochlorite-liberating agents include trichloromelamine, N,N-dichlorobenzolene, and N,N-dichloro-p-toluene sulfonamide. Mixtures of the hypochlorite sources may be used.

Alternately, water-soluble dry solid materials which generate chlorine on contact with, or dissolution in water can be used. Examples of these are heterocyclic N-chloroimides such as the trichloroisocyanuric acid, and dichloroisocyanuric acid and salts thereof such as sodium dichloroisocyanurate and potassium dichloroisocyanurate. Other imides which may be used include N-chlorosuccinimide, N-chloromalonimide, N-chlorophthalimide and N-chloronaphthalimide, and mixtures thereof. Additional suitable compounds are hydantoins such as 1,3-dichloro 5,5 dimethyl hydantoin; N-monochloro-5,5-dimethylhydantoin; methylene-bis (N-chloro-5,5-dimethylhydantoin); 1,3-dichloro-5-methyl-t-amylhydantoin, and the like.

In the preferred embodiment, commercial aqueous sodium hypochlorite (5¼ to 15 percent by volume NaOCl) is added to bromide-containing wash water in sufficient amounts to yield an initial hypochlorite ion concentration between about twenty-five and about ninety ppm. The solution containing textile materials is then agitated for a period of about 30 seconds and five minutes to provide intimate contact between the textile materials and the bleaching agent. When bleaching is completed, the bleached textile materials are removed and rinsed. The spent wash water is also discarded.

For a more complete understanding of the present invention, reference is made to the following examples. The examples are to be construed as illustrative and not limitative of the present invention.

EXAMPLE I

The cleaning capability of various liquid detergent compositions was determined for ten minute wash intervals. The total detergent concentration was varied, as was the solution temperature, to determine optimum temperatures and concentrations. The detergent compositions at the various temperatures and concentrations were also tested for increased cleaning ability in the presence of chlorine.

Three typical competitive liquid detergents were selected for purposes of comparison. An analysis of the composition of these three liquid detergents is set forth in Table I. The fourth detergent tested was fortified with sodium bromide. The components of this fourth detergent designated OPL Liquid E are set forth in Table II.

To determine cleaning efficiency a swatch of Empa 115 Bleach Cloth having initial reflectance of 29.5 as determined by a Hunter Reflectometer was agitated in solutions at 120° F. containing 0.06 weight percent, 0.12 weight percent or 0.24 weight percent of the various detergents and 100 ppm. chlorine. Similar swatches were treated in identical detergent solutions having no added chlorine.

After treatment the optical reflectance of each swatch was measured. The increase in optical reflectance over the initial sample indicates soil removal (ΔSR). The results are shown in Table III.

TABLE I

| ASSAY | COMPOSITION OF TEST LIQUID DETERGENTS COMPETITIVE A | COMPETITIVE B | COMPETITIVE C |
|---|---|---|---|
| Alkalinity as $Na_2O$ | | | |
| Total | 5.84 | 11.42 | 23.6 |
| Active | 2.42 | 9.60 | 26.0 |
| pH of 1% Solution | 10.7 | 12.53 | 12.7 |
| % Non-volatile | 45.0 | 46–51 | 67.0 |
| % Phosphate as $P_2O_5$ | 10.96 | 4.1 | 0.9 |
| % Anionic as LAS | — | 5.5 | — |
| % Nonionic | 6.65 | 3.35 | 14.7 |
| % Other Surfactant | 7.33 (Unknown) | 10.50 (Unknown) | 2.2 (Fatty Acids) |
| % Silicates as $SiO_2$ | 1.60 | Not Detected | |
| Citrates | — | — | Present |

TABLE II

| OPL LIQUID FORMULATION Ingredient | Weight (%) |
|---|---|
| Water | 34.9 |
| Fabric Brightener(1) | 0.1 |
| Polyacrylate(2) | 2.0 |
| Caustic Lye(3) | 1.0 |
| Nonionic Surfactant(4) | 18.0 |
| Polyelectrolyte(5) | 20.0 |
| NaOH(6) | 2.0 |
| Sodium Silicate | 8.0 |
| Sodium NTA | 10.0 |
| Sodium Bromide | 2.0 |
| Anionic Surfactant(7) | 2.0 |

(1)A distearyl diphenyl derivative, sold by Ciba-Geigy under the trade name Tinopal CBS-X.
(2)polyacrylic acid, sold by B. F. Goodrich Co. under the trade name Goodrite K-732.
(3)Present as a 50 percent solution.
(4)An ethoxylated nonylphenol, sold by GAF Corporation under the name Igepal CO 530.
(5)A partially esterified copolymer of maleic acid and methyl vinyl ether sold by GAF Corporation.
(6)Present as a 50 percent aqueous solution.
(7)Sodium salt of a alkyl aryl sulfonic acid sold by Pilot chemical under the trade name Calsoft 90.

TABLE III

| | 10 Minutes Agitation at 120° F. Detergent Concentration (wt. %) | ΔSR 100 ppm. Chlorine Added | ΔSR No Chlorine Added |
|---|---|---|---|
| Competitive A | 0.06 | 50.50 | 1.01 |
| | 0.12 | 51.34 | 1.46 |
| | 0.24 | 50.10 | 1.04 |
| Competitive B | 0.06 | 46.82 | 0.95 |
| | 0.12 | 44.07 | 0.85 |
| | 0.24 | 39.51 | 0.92 |
| Competitive C | 0.06 | 39.88 | 2.96 |
| | 0.12 | 38.03 | 1.80 |
| | 0.24 | 35.15 | 3.16 |
| OPL Liquid E | 0.06 | 51.50 | 1.46 |
| | 0.12 | 51.34 | 1.63 |
| | 0.24 | 50.10 | 1.54 |

EXAMPLE II

The procedure outlined in Example I was repeated on new swatches at solution temperatures of 100° F. The results are shown in Table IV.

TABLE IV

| | 10 Minutes Agitation at 100° F. Detergent Concentration (wt. %) | ΔSR 100 ppm. Chlorine Added | ΔSR No Chlorine Added |
|---|---|---|---|
| Competitive A | 0.06 | 46.93 | 0.81 |
| | 0.12 | 45.80 | 0.95 |
| | 0.24 | 45.56 | 1.01 |
| Competitive B | 0.06 | 37.86 | 0.58 |
| | 0.12 | 36.09 | 1.14 |
| | 0.24 | 30.85 | 1.02 |
| Competitive C | 0.06 | 34.90 | 1.16 |
| | 0.12 | 27.23 | 1.16 |
| | 0.24 | 26.16 | 1.27 |
| OPL Liquid E | 0.06 | 48.84 | 1.17 |
| | 0.12 | 48.45 | 1.03 |
| | 0.24 | 48.78 | 0.92 |

EXAMPLE III

The procedure outlined in Example I was repeated with new swatches at solution temperatures of 80° F. The results are shown in Table V.

TABLE V

| | 10 Minute Agitation at 80° F. Detergent Concentration (wt. %) | ΔSR 100 ppm. Chlorine Added | ΔSR No Chlorine Added |
|---|---|---|---|
| Competitive A | 0.06 | 41.01 | 0.45 |
| | 0.12 | 41.37 | 1.27 |
| | 0.24 | 39.90 | 1.43 |
| Competitive B | 0.06 | 26.95 | 0.57 |
| | 0.12 | 21.39 | 0.71 |
| | 0.24 | 20.52 | 0.70 |
| Competitive C | 0.06 | 23.34 | 1.99 |
| | 0.12 | 18.14 | 0.86 |
| | 0.24 | 15.68 | 0.68 |
| OPL Liquid E | 0.06 | 45.49 | 1.67 |
| | 0.12 | 45.46 | 1.17 |
| | 0.27 | 44.84 | 0.88 |

EXAMPLE IV

The procedure outlined in Example I was repeated using 50 ppm. and 100 ppm. chlorine concentrations. The wash interval wash was shortened to five minutes. The results are shown in Table VI.

By comparing the results of Tables III and VI, it can be seen that reduction of the agitation time from 10 to 5 minutes with 100 ppm chlorine concentrations does not reduce the bleaching effectiveness of OPL Liquid E as dramatically as the non-bromide ion containing compositions. OPL Liquid E combined with 100 ppm chlorine provides effective bleaching in washing intervals which are one-half the conventional periods.

TABLE VI

| | 5 Minute Agitation at 120° F. | | |
|---|---|---|---|
| | Detergent Concentration (wt. %) | ΔSR 50 ppm. Chlorine Added | ΔSR 100 ppm. Chlorine Added |
| Competitive A | 0.06 | 17.9 | 24.0 |
| | 0.12 | 16.4 | 23.6 |
| | 0.24 | 16.0 | 25.0 |
| Competitive B | 0.06 | 9.5 | 15.0 |
| | 0.12 | 7.6 | 12.8 |
| | 0.24 | 6.0 | 11.4 |
| Competitive C | 0.06 | 8.8 | 3.8 |
| | 0.12 | 7.7 | 12.0 |
| | 0.24 | 7.1 | 11.5 |
| OPL Liquid E | 0.06 | 29.5 | 34.0 |
| | 0.12 | 32.3 | 36.3 |
| | 0.24 | 33.4 | 38.0 |

EXAMPLE V

The procedure outlined in Example II was repeated using 50 ppm. and 100 ppm. chlorine concentrations. The wash interval was shortened to five minutes. The results are shown in Table VII.

As can be seen from a comparison of Tables VI and VII, the bleaching capability at 100° F. of the OPL liquid containing a source of bromide ions and either 50 ppm or 100 ppm chlorine is affected less by the decrease in wash intervals than the other non-bromide ion-containing bleaching compositions.

TABLE VII

| | 5 Minute Agitation at 100° F. | | |
|---|---|---|---|
| | Detergent Concentration (wt. %) | ΔSR 50 ppm. Chlorine Added | ΔSR 100 ppm. Chlorine Added |
| Competitive A | 0.06 | 12.4 | 16.7 |
| | 0.12 | 9.7 | 16.9 |
| | 0.24 | 9.8 | 16.1 |
| Competitive B | 0.06 | 6.1 | 11.3 |
| | 0.12 | 5.3 | 9.7 |
| | 0.24 | 4.0 | 6.5 |
| Competitive C | 0.06 | 6.1 | 8.4 |
| | 0.12 | 5.5 | 7.0 |
| | 0.24 | 4.8 | 6.2 |
| OPL Liquid E | 0.06 | 25.1 | 28.2 |
| | 0.12 | 29.1 | 31.2 |
| | 0.24 | 29.9 | 34.6 |

EXAMPLE VI

The procedure outlined in Example III was repeated using 50 ppm. and 100 ppm. chlorine concentration. The wash interval was decreased to five minutes. The results are shown in Table VIII.

As can be seen from a comparison of Tables V and VIII the bleaching capability of the OPL liquid and either 50 ppm or 100 ppm chlorine is largely uneffected by the reduction in the wash interval.

TABLE VIII

| | 5 Minute Agitation at 80° F. | | |
|---|---|---|---|
| | Detergent Concentration (wt. %) | ΔSR 50 ppm. Chlorine Added | ΔSR 100 ppm. Chlorine Added |
| Competitive A | 0.06 | 6.3 | 9.8 |
| | 0.12 | 7.6 | 9.5 |
| | 0.24 | 7.3 | 12.0 |
| Competitive B | 0.06 | 4.2 | 6.9 |
| | 0.12 | 3.3 | 5.4 |
| | 0.24 | 0.9 | 4.2 |
| Competitive C | 0.06 | 2.8 | 4.8 |
| | 0.12 | 3.3 | 3.7 |
| | 0.24 | 2.4 | 2.8 |
| OPL Liquid E | 0.06 | 21.2 | 23.4 |
| | 0.12 | 24.0 | 26.2 |
| | 0.24 | 24.3 | 27.5 |

It can be seen from the data that detergent enhanced with bromide ion provides more effective and efficient cleaning at 100 ppm. chlorine concentration at temperatures between about 80° F. and 120° F. Furthermore, bromide ion-enhanced detergent provides cleaning efficiency at 50 ppm. chlorine approximately equivalent conventional detergents at 100 ppm. chlorine.

I claim:

1. A method for reducing the time period required for bleaching textile materials in water without sacrificing cleaning efficiency comprising the steps of:

adding a source of bromide ions to a wash water containing textile materials to be bleached in an amount sufficient to impart an initial bromide ion concentration between about one and about twenty-five parts per million;

adding a source of chlorine-containing ions in an amount sufficient to yield an initial chloride ion concentration in an amount between about fifty and about ninety parts per million;

agitating the wash water to provide intimate contact between the textile materials and bleaching agents while the bleaching agents are added;

maintaining the textile materials in the wash water with agitation for a period between about 30 seconds and five minutes; and recovering the textile materials from the wash water in an effectively bleached condition.

2. The method as set forth in claim 1 wherein the bromide ion source is a compound selected from the group consisting of alkali or alkaline earth metal bromide salts, or mixtures thereof.

3. The method as set forth in claim 1 wherein the source of bromide ions is sodium bromide.

4. The method as set forth in claim 2 wherein the source of bromide ions is in admixture with an organic surfactant.

5. The method as set forth in claim 4 wherein the surfactant is present in a detergent composition, the detergent composition consisting essentially of from about zero to about one-hundred weight percent of the organic surfactant.

6. The method as set forth in claim 5 wherein the detergent composition further comprises a water-soluble builder salt in an amount at least two-thirds of the amount of the surfactant and about one-eighth to one percent by weight alkali metal bromide.

7. The method as set forth in claim 1 wherein the source of chlorine ions is a compound selected from the group consisting of:

alkali metal hypochlorites, alkaleñe earth metal hypochlorites, trichloro melamine, N,N-dichlorobenzolene, N,N-dichloro-p-toluene sulfonamide, heterocyclic N chloromides, chlorinated alkyl hydantoins and mixtures thereof.

8. The method as set forth in claim 7 wherein the source of chlorine ions is an alkali metal hypochlorite.

9. The method as set forth in claim 7 wherein the source of chlorine ions is sodium hypochlorite.

10. The method as set forth in claim 3 wherein the source of chlorine ions is a compound taken from the group consisting of:

alkali metal hypochlorites, alkaline earth metal hypochlorites, trichloro melamine, N,N-dichlorobenzolene, N,N-dichloro-p-toluene sulfonamide, heterocyclic N chloromides, chlorinated alkyl hydantoins and mixtures thereof.

11. The method as set forth in claim 9 wherein the source of chlorine ions is sodium hypochlorite.

12. The method as set forth in claim 1 wherein the wash water is maintained at a temperature in the range of from about 80° F. to about 120° F.

13. The method as set forth in claim 1 wherein the pH of the wash water is maintained between about 6.5 and about 10.5.

14. The method as set forth in claim 1 wherein the pH of the wash water is maintained between about 6.5 and about 10.0.

15. The method as set forth in claim 14 wherein the temperature of the wash water is maintained in the range of about 80° F. and about 120° F.

16. A method for reducing the time required to bleach textile materials in water comprising the steps of:

first, adding sufficient sodium bromide to wash water containing the textile material to be bleached to yield an initial bromide ion concentration of about one to about twenty-five parts per million;

then, adding sodium hypochlorite to the solution to provide an initial chloride ion concentration between about fifty and about ninety parts per million;

maintaining the pH of the treated wash water between about 6.5 and about 10.5;

agitating the wash water to provide intimate contact between the textile materials and the bromide and chlorine ions while the bromide and chloride ions are added;

maintaining the textile materials in the wash water with agitation for a period between about thirty seconds and about five minutes; and recovering the textile material from the wash water.

17. A method for reducing the amount of chlorine ion in solution required to bleach textile materials in water comprising the steps of:

first, adding a source of bromide ions to wash water containing the textile materials to be bleached to yield an initial bromide ion concentration of about one to about twenty-five parts per million;

then, adding a source of chloride ion to the solution to provide an initial chloride ion concentration between about twenty-five and about fifty parts per million;

maintaining the pH of the treated wash water between about 6.5 and about 10.5;

agitating the wash water to provide intimate contact between the textile materials and the bromide and chloride ions during the addition of the bromide and chloride ions;

maintaining the textile materials in the wash water with agitation for a period between about five and about ten minutes; and recovering the textile materal from the wash water.

18. The method as set forth in claim 17 wherein the bromide ion source is a compounds taken from the group consisting of alkali or alkaline earth bromide salts or mixtures thereof.

19. The method as set forth in claim 17 wherein the source of bromide ions is sodium bromide.

20. The method as set forth in claim 17 wherein the source of bromide ions is incorporated with a surfactant.

21. The method as set forth in claim 17 wherein the surfactant is present in a detergent composition, the detergent composition consisting essentially of:

from about zero to about one-hundred percent by weight of an organic surfactant;

about zero to about one-hundred percent by weight of a water-soluble builder salt; and about one-eighth to about one percent by weight alkali metal bromide.

22. The method as set forth in claim 17 wherein the source of chloride ions is an alkali metal hypochlorite.

23. The method as set forth in claim 17 wherein the temperature of the wash water is maintained in the range of about 80° F. and about 120° F.

24. The method as set forth in claim 17 wherein the pH of the wash water is maintained between about 6.5 and about 10.0.

* * * * *